United States Patent [19]

Merl

[11] 4,205,763

[45] Jun. 3, 1980

[54] CONTAINER DISPENSING DEVICE

[75] Inventor: Milton Merl, New City, N.Y.

[73] Assignee: Marlboro Marketing, Inc., New York, N.Y.

[21] Appl. No.: 972,683

[22] Filed: Dec. 26, 1978

[51] Int. Cl.[2] ..... A47F 7/00

[52] U.S. Cl. ..... 221/173; 211/49 D

[58] Field of Search ..... 221/289, 303, 22, 173; 312/45, 72; 211/49 D; 193/32, 40

[56] References Cited

U.S. PATENT DOCUMENTS

| | | | |
|---|---|---|---|
| 2,212,129 | 8/1940 | Rust | 221/289 |
| 2,218,444 | 10/1940 | Vineyard | 211/49 D |
| 2,707,042 | 4/1955 | Weiler | 193/32 X |
| 3,298,763 | 1/1967 | Di Domenico | 211/49 D X |
| 3,306,688 | 2/1967 | Di Domenico | 211/49 D X |

*Primary Examiner*—Allen N. Knowles
*Attorney, Agent, or Firm*—Henry R. Lerner

[57] ABSTRACT

An automatic dispenser for cylindrical containers is disclosed in which containers are disposed one-by-one from a vertical presentment position. The dispenser comprises a storage compartment which stores the containers substantially horizontally in a side-by-side relationship, and a dispenser portion which is located at one end of the storage compartment. The storage compartment has a downward and sideway slant so that the containers are gravitationally urged to roll towards the dispenser portion. The degree of slant of the surface upon which the containers move is such as to provide sufficient torque when the container engages a swivel means to cause it to swivel and drop from the stored horizontal to vertical presentment positions.

8 Claims, 9 Drawing Figures

CONTAINER DISPENSING DEVICE

BACKGROUND OF THE INVENTION

This invention relates to an automatic dispensing system for cylindrical containers and the like in which the containers are retrieved from a vertical presentment position.

Conventionally, dispensers for cylindrical containers are complicated, often involving various mechanical and electro-mechanical means for presenting individual containers to be retrieved from the dispenser. Such devices are expensive, unwieldy, and often are unreliable in performance due to the large number of moving parts cooperating so as to present each container in a vertical position for retrieval. Further, such devices are incapable of handling large numbers of containers without materially complicating the machinery for container handling and storage.

With the burgeoning soft drink and liquid container industries, it has become increasingly important to provide an efficient, reliable and inexpensive dispensing system, which eliminates many of the problems encountered in the prior art. Simplicity in operation, ease in manufacture, and inexpensive materials are all desirable in an automatic container dispenser system.

An object of this invention is to provide an improved automatic dispenser system for cylindrical containers and the like.

Another object of this invention is to provide such a dispenser which is inexpensive to manufacture, efficient in use, and simple to maintain.

Yet another object of this invention is to provide such an automatic dispenser which eliminates the use of moving parts and interconnected mechanical and electromechanical elements in the functioning of the automatic presentation of individual containers for retrieval.

Another object of this invention is to provide such an automatic dispenser which is capable of expanding to handle large numbers of containers without materially altering or changing the basic arrangement of the dispenser.

Yet another object of this invention is to provide such an automatic dispenser system which is made of relatively maintenance free and durable materials, which will not be impaired if any of the liquid held in the containers leaks on the dispenser.

Other objects, advantages and features of this invention will become more apparent from the following description.

SUMMARY OF THE INVENTION

In accordance with the principles of this invention, an automatic dispenser for cylindrical containers is provided which comprises a storage compartment portion adapted to hold the containers in a horizontal side-by-side relationship while being stored and a dispenser portion located at one end of the storage compartment to which the containers are fed, one-by-one to be in vertical presentment position for retrieval. The storage compartment comprises a container receiving surface slanted downwardly toward the dispenser portion, as well as sideways, with container swivel means located at the bottom of the storage compartment section, the containers being gravitationally urged to roll towards the dispenser portion, with each of the containers abutting said swivel means as it reaches the dispenser portion, said swivel means causing said container to swivel from said stored horizontal position to drop to a vertical presentment position. The downward plus sideways slant of the surface permits the containers to develop sufficient momentum so that the momentum of the container coupled with the gravitational pull enables the containers to fall into the dispenser.

The dispenser, preferably, is formed of a molded plastic material, and the storage compartment portion includes integrally formed guide rails which guide the rolling cylindrical containers toward the dispenser portion end of the storage compartment. Preferably, the storage compartment and dispenser portion are integrally formed of said plastic material, with the swivel means also being integral therewith to facilitate inexpensive and efficient manufacturing operations.

Since the automatic dispenser operates under normal gravitational force, elimination of complex and undesirable mechanical and electro-mechanical dispensing mechanisms is achieved. Further, utilization of said normal gravitational force enables the containers to be dispensed in a natural fashion, with the containers naturally rolling down toward the dispenser portion. The momentum of the containers is such as to allow the swivel means to interrupt the normal rolling movement causing each of the containers to swivel and drop to a vertical presentment position from which it is retrieved.

The dispenser is preferably utilized with containers having a top portion which is narrower than the body portion, so that as the container hits the swivel means, the bottom portion already has reached the dispenser portion enabling it to drop downwardly as it swivels into the vertical presentment position. The dispenser is equally usable, however, with containers having top portions which are extensions of the bottom portions, i.e., having the same diameter.

It should be noted that the individual dispenser systems can be expanded to house multiple rows of cylindrical containers, with each of the rows operating independently of the other. In this manner, expansion of the automatic dispenser system is easily achievable without detracting from the operation of any of the individual compartments.

DESCRIPTION OF THE PREFERRED EMBODIMENT

Figure 1:
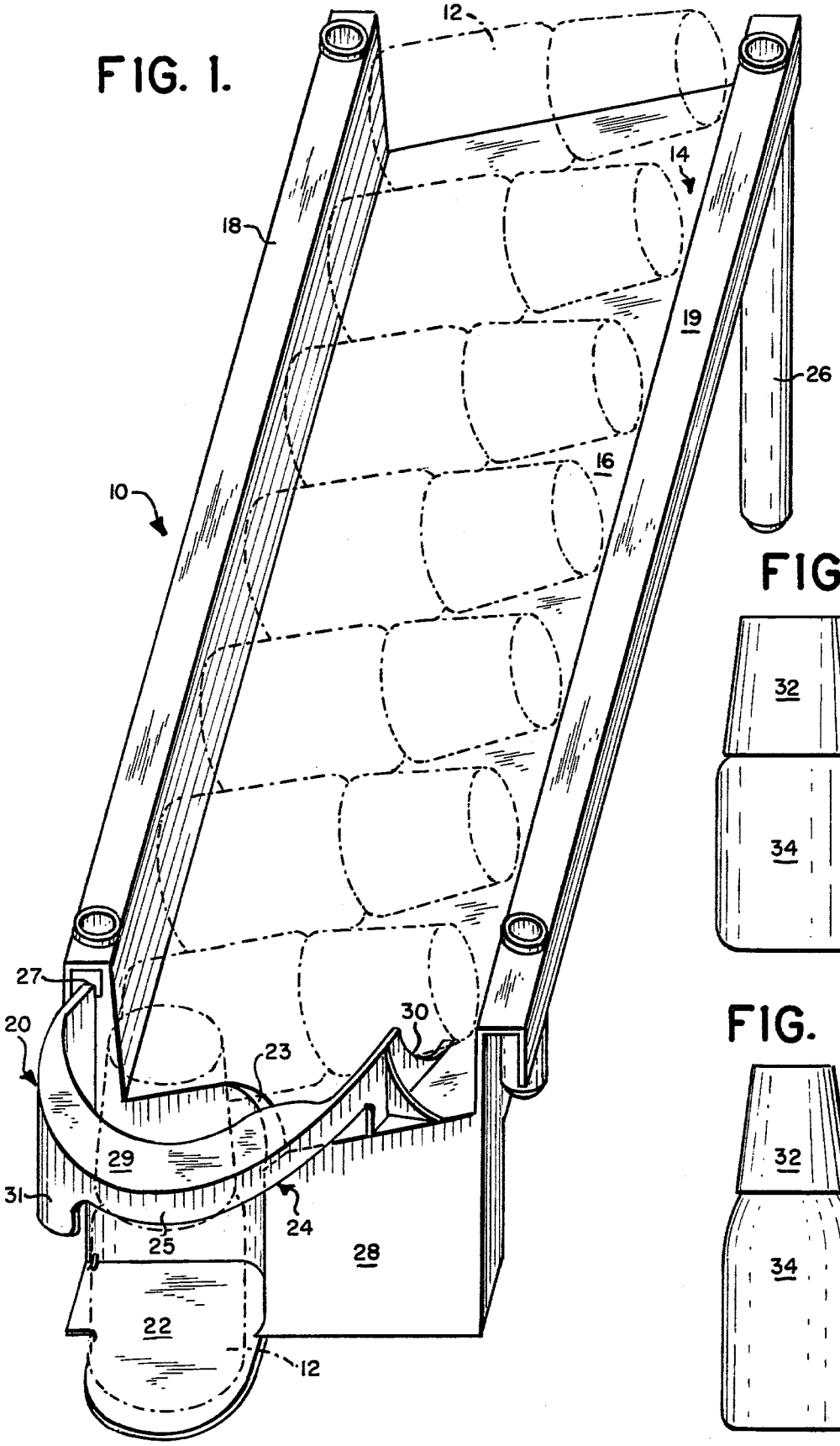
FIG. 1 is a perspective view of the automatic dispenser forming this invention with cylindrical containers illustrated in the stored and presentment positions.

Referring to the drawings, there is shown in FIG. 1 a dispenser 10 housing a plurality of cylindrical containers or bottles 12 stored in a substantially horizontal side-by-side position in a storage compartment portion 14 of the dispenser. The compartment portion 14 comprises a container receiving surface 16 terminating in side guides 18–19 which urge the containers to be in a side-by-side position when in the stored condition.

The dispenser container receiving surface 16 is formed to be slanted sideways (toward left guide 18 viewing FIG. 1) as well as toward a dispenser portion 20 which is located at one end or the front end of the storage compartment 14. The dispenser portion comprises a horizontal platform 22 located below surface 16 upon which containers to be dispensed drop and rest. The dispenser portion is bordered at its forward end by an integrally formed guard rail 24 for guiding the containers as they drop on platform 22 and for holding the containers in the vertical presentment position prior to their being removed from the platform 22. A slide surface 23 is integrally formed at the front right edge of storage surface 16 and serves to assist the containers moving into their vertical presentment position.

The rear end of the dispenser is raised in relation to front portion 28 of the storage compartment by conventional means such as, for example, rear legs 26, so as to provide the downward slant to surface 16 for gravitationally urging the containers to roll toward the dispenser portion 20 of the automatic dispenser. Further, the right side edge of surface 16 is slightly higher than the left side edge thereof so as to provide the sideways slant to said surface for reasons more fully set forth hereafter. There are normally two forces acting on each container to bring it from the stored to the presentment positions. One is the gravity force due to the slanted surface acting on the container and the other is the pushing force exerted by the remaining of stored containers.

The guard rail 24 is generally C-shaped having a forward seat surface section 25, an end 27 integrally connected with the left guide 18 and an arcuate free end 30 which is spaced from the right side guide 19 and defines a swivel means as hereinafter described. A top edge 29 built from section 25 extends towards storage compartment 14 and is so sized to bear against the top 32 of container 12 when it is in the vertical position to firmly hold the container in place.

The guard rail also includes a partial vertical wall segment 31 depending from top edge 29 and partially encircling forward seat surface 25. The wall segment 31 serves to guide the bottom of the container as it drops onto platform 22.

As the bottles or containers 12 roll toward the front or dispenser portion 20, the top section 32 of each of the containers abuts arcuate swivel means 30 which is impacted upon by the curved upper portion 32 of the container, causing said container to pivot thereabout, from the horizontal disposition thereof to a vertical disposition thereof and to drop onto platform 22.

Figure 9:
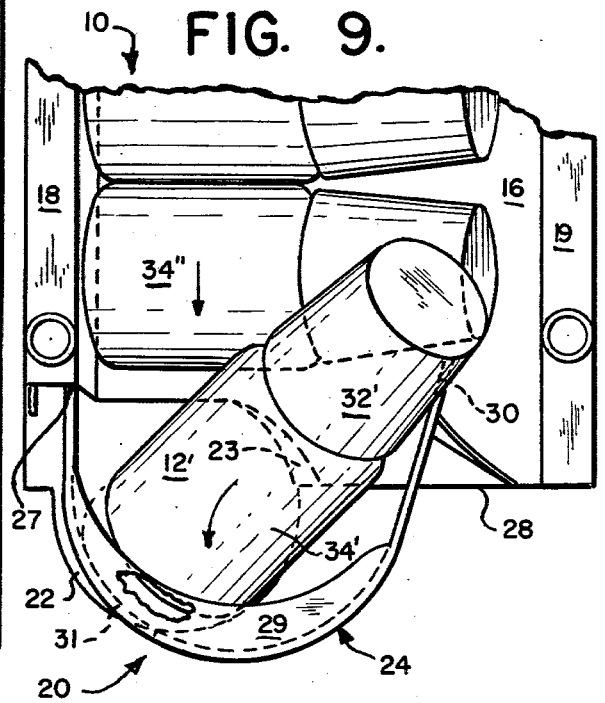
FIG. 9 is a top view similar to FIG. 8 pictorially illustrating the swiveling of the next container from the horizontal stored position to the vertical presentment position after removal of the preceding container as shown in FIG. 8.

The swivel means 30 is located approximately one-quarter to one-third the way across the storage compartment as viewed from right guide 19 positioning said swivel means so as to be in engagement with the stored container next to move into the presentment position. When an upstanding container is removed from dispenser portion 20, the next container rotates counterclockwise (viewing FIGS. 1 and 9) about swivel means 30 because of the torque exerted by the weight of the container about swivel means 30 which acts as a fulcrum. The forces acting on the container cause it to start to slide into the dispenser portion 20 as it moves over slide surface 23. The bottom of the container slides down along vertical wall segment 31 as it falls onto platform 22 and upon reaching the upstanding position, the upper portion 32 of the container bears against top edge 29 of guard rail 24.

Figure 2:
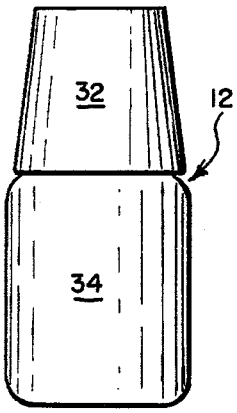
FIGS. 2 and 3 are side views of the type of containers used with the dispenser of FIG. 1.
Figure 3:
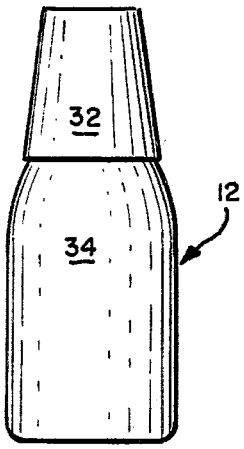
Figure 4:
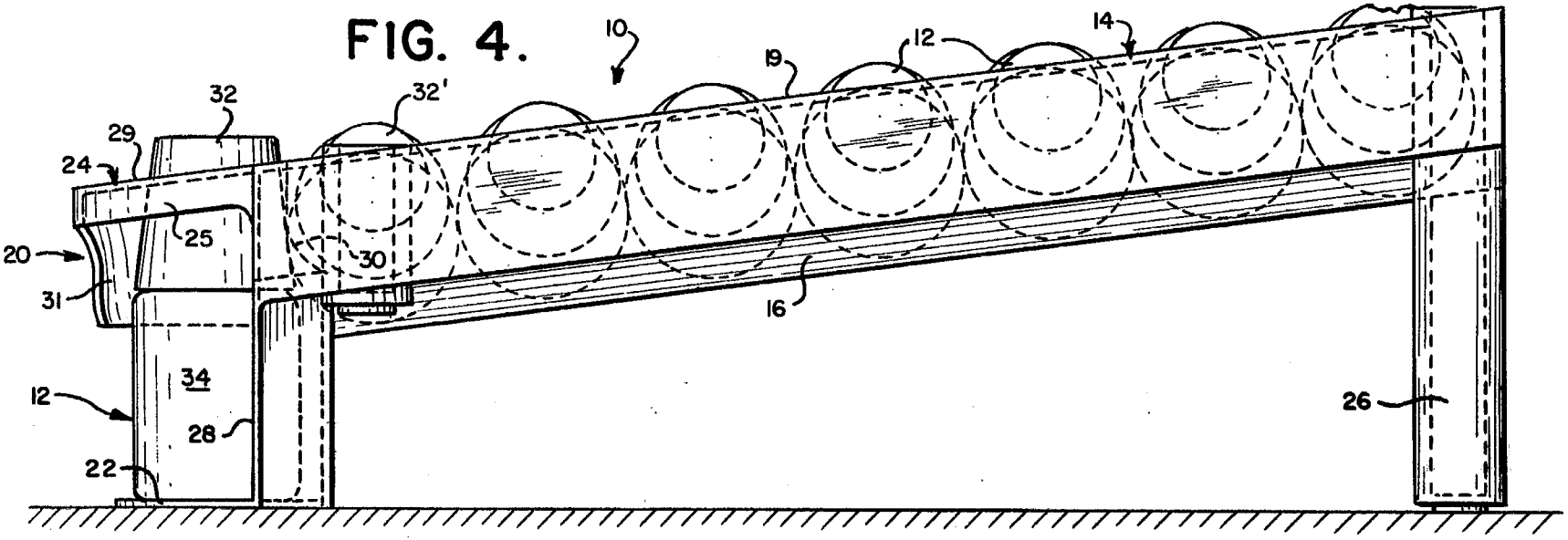
FIG. 4 is a side view of the dispenser of FIG. 1.
Figure 5:
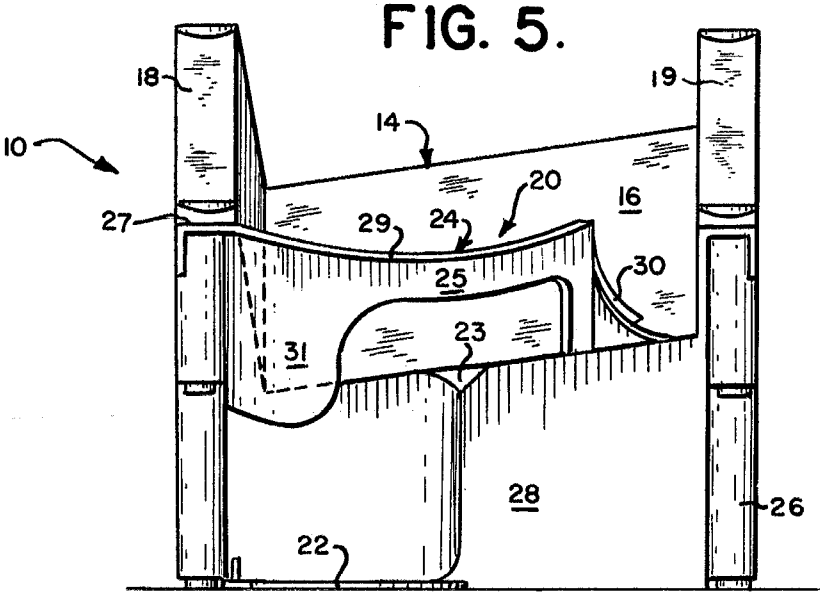
FIG. 5 is a front view of the dispenser of FIG. 1 without the containers.
Figure 6:
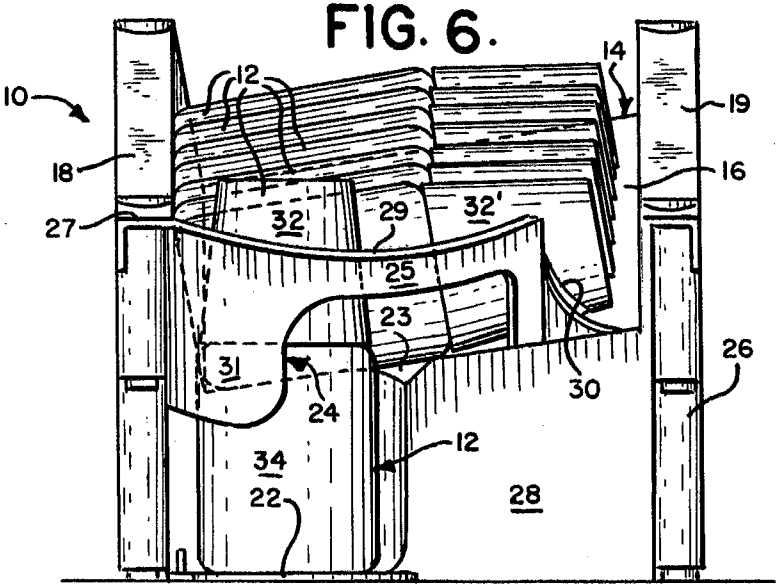
FIG. 6 is a front view similar to FIG. 5 with the containers held in the dispenser.
Figure 7:
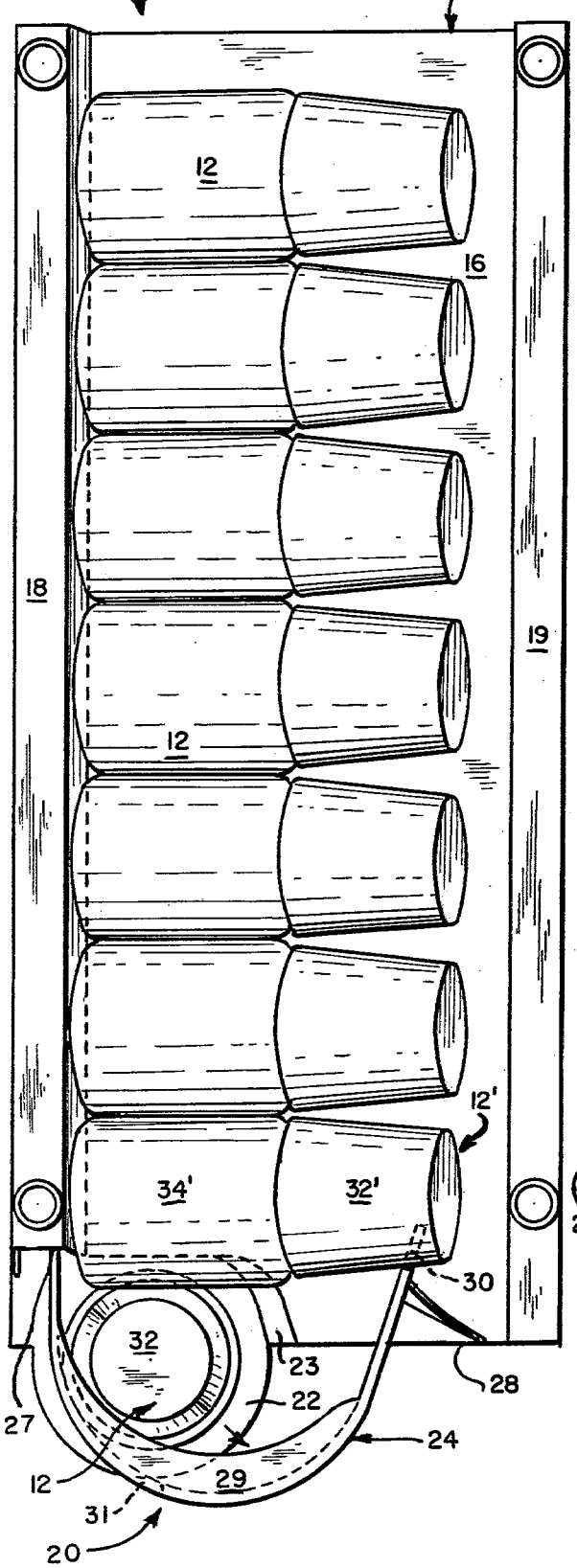
FIG. 7 is a top view of the dispenser of FIG. 1.

FIGS. 2 and 3 illustrate two types of containers which can preferably be used with the automatic dispenser of this invention, with each of the containers having the top portion 32 narrower than bottom portion 34. As previously stated, however, uniform diameter top and bottom portions could equally well be used.

Figure 8:
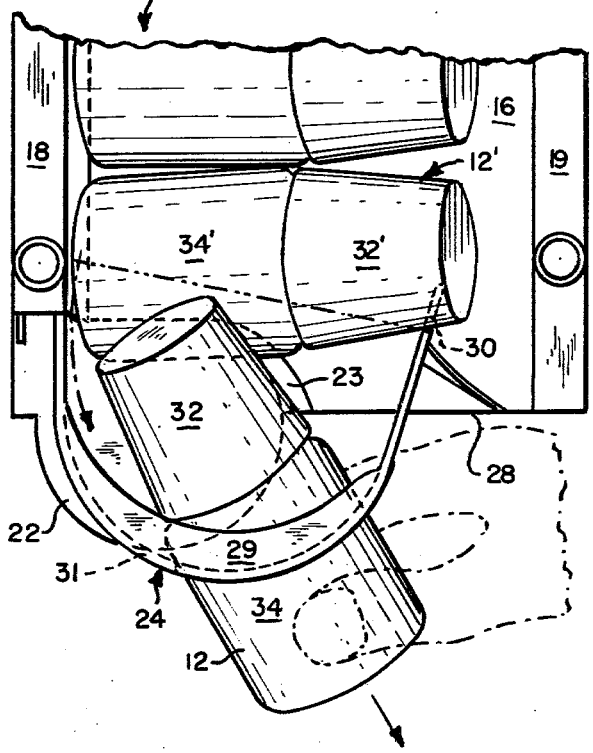
FIG. 8 is a top view pictorially illustrating a container being removed from the dispenser from the vertical presentment position.

As may be clearly seen in FIGS. 1, 4, 6 and 7, when a container is in the presentment position it simultaneously serves as a natural stop for the remaining containers held in the storage compartment. Thus, the bottom 34' of the next horizontally disposed bottle or container 12' to drop into the dispenser portion bears against the top 32 of the container presently upstanding in the dispenser portion. As one bottle 12 is removed from the presentment position (FIG. 8) the forces acting upon the next bottle 12' cause it to move downwardly into the well of the dispenser portion and to drop onto the platform 22. This is more clearly seen in FIG. 9, in which bottle 12 has been removed from the dispenser portion (FIG. 8) and the next bottle 12' is dropping downwardly into the dispenser portion. Prior to removal of bottle 12, the top 32' of bottle 12' is in engagement with swivel or fulcrum means 30. As bottle 12' completes its swivel movement into the vertical presentment position, the top 32' of bottle 12' will bear against the bottom 34'' of the next bottle to ensure that the succeeding containers or bottles are maintained in their stored side-by-side orientation.

The automatic dispenser of this invention may preferably be made of a molded plastic material so as to minimize expense and maintenance. Further, use of plastic materials will enable a savings to be achieved with the structural support for the container receiving surface being achieved by only that much material which will prevent the containers from falling through the storage compartment from the container receiving surface while in the stored position. It should be noted that if any of the containers happens to leak, the use of plastic materials for the dispenser ensures the minimization of interference of the normal operation of the containers, and the later cleaning of the dispenser system can easily be achieved.

The present invention enables an efficient and inexpensive automatic dispenser system to be provided in which the normal gravitational force upon the containers is positively used in cooperation with the shape of the containers to enable such containers, one by one, to be automatically moved from the normal horizontally stored position to a vertical dispensed position.

Further, while there is herein shown and described the preferred embodiment of the invention, it will be understood that the invention may be embodied otherwise than as herein specifically illustrated or described, and that in the illustrated embodiment certain changes in the details of construction and in the form and arrangement of parts may be made without departing from the underlying idea or principles of this invention within the scope of the appended claims.

What is claimed is:

1. An automatic dispenser for cylindrical containers or the like comprising a storage compartment portion adapted to hold containers in horizontal side-by-side relation while being stored and a dispenser portion at one end of said compartment portion to which said containers are fed, one-by-one, in an upstanding vertical presentment position for retrieval, said compartment comprising a container receiving surface slanted downwardly toward said dispenser portion and slanted sidewardly, and container swivel means located at the bottom of said compartment, said containers being gravitationally urged to roll toward said dispenser portion, each of said containers abutting said swivel means as it reaches said dispenser portion, said swivel means causing said container to swivel from said stored horizontal position to said upstanding position thereof wherein it is retrievable.

2. An automatic dispenser as set forth in claim 1, wherein said dispenser is formed of a plastic material.

3. An automatic dispenser as set forth in claim 1, wherein said storage compartment portion, said swivel means, said dispenser portion and said container receiving surface are integrally formed as a single unit.

4. An automatic dispenser as set forth in claim 1, wherein said swivel means has an arcuate shape complementary to the tops of said containers and being so located such that the next stored container is in engagement with said arcuate shape prior to removal of the upstanding container from said dispenser portion, said next stored container pivoting about said swivel means when said upstanding container is removed due to the static gravitational forces acting on said next stored container.

5. An automatic dispenser as set forth in claim 4, wherein said dispenser portion comprises a C-shaped guard railing extending forwardly from said storage compartment, and a platform located below said container receiving surface, said upstanding containers resting on said platform and C-shaped guard railing holding said upstanding container in position when on said platform, said swivel means being defined by a free end of said C-shaped guard.

6. An automatic dispenser as set forth in claim 5, wherein said platform is so located with respect to said container receiving surface such that the top of the upstanding container bears against the bottom of the next stored container maintaining said stored containers in said side-by-side relationship.

7. An automatic dispenser as set forth in claim 6, wherein said guard rail comprises a downwardly extending partial wall segment located toward the bottom of said containers, said wall segment contacting and guiding said containers as they drop onto said platform.

8. An automatic dispenser as set forth in claim 7, wherein said container receiving surface further comprises a slide surface located at the front of said container receiving surface, said slide surface contacting the upper portion of said container to guide it toward said wall segment as the next stored container begins to move to its upstanding position.

* * * * *